US007837490B2

(12) United States Patent
Sakamoto et al.

(10) Patent No.: US 7,837,490 B2
(45) Date of Patent: Nov. 23, 2010

(54) SEAL MEMBER FOR WATERPROOF CONNECTOR

(75) Inventors: Nobuyuki Sakamoto, Makinohara (JP); Keiko Azuma, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/762,210

(22) Filed: Jun. 13, 2007

(65) Prior Publication Data

US 2007/0293075 A1 Dec. 20, 2007

(30) Foreign Application Priority Data

Jun. 16, 2006 (JP) ..... 2006-167560

(51) Int. Cl.
*H01R 13/52* (2006.01)

(52) U.S. Cl. ..... 439/278

(58) Field of Classification Search ..... 439/278, 439/587, 271, 275, 357, 279, 588–589, 282
See application file for complete search history.

(56) References Cited

U.S. PATENT DOCUMENTS 4,643,506 A * 2/1987 Kobler ..... 439/271
5,540,450 A * 7/1996 Hayashi et al. ..... 277/607
5,634,807 A * 6/1997 Saito ..... 439/275
6,716,063 B1 * 4/2004 Bryant et al. ..... 439/589
2002/0098735 A1 * 7/2002 Hattori et al. ..... 439/587
2002/0115345 A1 * 8/2002 Nakamura et al. ..... 439/587
2005/0042906 A1 * 2/2005 Tabata et al. ..... 439/274

FOREIGN PATENT DOCUMENTS

JP 2000208200 A 7/2000

* cited by examiner

*Primary Examiner*—Edwin A. Leon
(74) *Attorney, Agent, or Firm*—Sughrue Mion, PLLC

(57) ABSTRACT

To provide a seal member for a waterproof connector which will not be deteriorated in waterproof performance even when wires swing, and is suited for use even in the type of connector in which an inner housing is swingable as in a floating connector, a seal member for a waterproof connector is mounted at rear ends of terminal receiving chambers of the waterproof connector, and has wire-sealing passage holes in which wires connected to respective terminals can be fitted, respectively. Lip portions are formed on an outer peripheral portion of the seal member over an entire periphery thereof, and also lip portions are formed on front and rear sides of the seal member spaced from each other in an inserting direction, and these lip portions can be compressed and deformed between the seal member and the terminal receiving chambers.

14 Claims, 8 Drawing Sheets

SEAL MEMBER FOR WATERPROOF CONNECTOR

BACKGROUND OF THE INVENTION

1. Filed of the Invention

This invention relates to a seal member for a waterproof connector which can secure a waterproof performance for preventing the intrusion of water into a connector housing.

2. Description of the Related Art

As shown in FIGS. 9 and 10, a conventional waterproof connector 101 includes female terminals 104 inserted respectively in terminal receiving chambers 103 of a housing 102, and a seal member 106 which is mounted at rear ends of the terminal receiving chambers 103, and has a plurality of wire-sealing passage holes 107. A press-clamping portion 109 for the fixing of a sheath portion and a conductor portion of a wire W thereto is formed at a rear portion of the female terminal 104.

A packing holder 110 having a packing 111 is fitted to the housing 102 from a front side thereof, thereby securing a dust-proof and waterproof performance for preventing the intrusion of dust and water from the front side. Further, a side spacer 112 is inserted into the housing 102 from a side surface thereof, and stoppers 112*a* hold rear end surfaces of box-like electrical contact portions 105 of the female terminals 104, thereby preventing rearward withdrawal of the female terminals 104. An inner surface of each passage hole 107, as well as an outer peripheral surface of the seal member 106, is corrugated to form seal portions or lips 107*a*, and these seal portions 107*a* seal the outer peripheral surfaces of the wires W and the rear end portions of the terminal receiving chambers 103.

A rear holder 113 is attached to the rear end of the housing 102, and is disposed at the rear side of the seal member 106 to presses this seal member 106. This rear holder 113 has a plurality of terminal passage holes 114. Further, a lance cover 115 for covering a lock mechanism until the connector 101 is fitted to a mating connector is attached to an upper surface of the rear portion of the housing 102.

In the waterproof connector 101 of the above construction, first, the packing holder 110 is attached to the housing 102 from the front side thereof, and then the seal member 106 is inserted into the housing 102 to be disposed at the rear side of the terminal receiving chambers 103. Thereafter, the rear holder 113 is provisionally retained at the rear end of the housing 102 to be disposed at the rear side of the seal member 106.

Then, each female terminal 104 having the wire W fixedly secured to the press-clamping portion 109 is inserted from the rear side of the rear holder 113 (provided at the rear end of the housing 102) into the terminal receiving chamber 103 through the terminal passage hole 114 and the passage hole 107 of the seal member 106. Thereafter, the rear holder 113 disposed at the rear side of the seal member 106 is pushed toward the front side of the housing 102, and is completely retained, and as a result the seal member 106 is elastically deformed to achieve a positive sealing effect.

After the female terminals 104 are received respectively in the terminal receiving chambers 103, the side spacer 112 is inserted into the housing 102 from the side surface thereof, so that the stoppers 112*a* are disposed respectively at the rear end surfaces of the box-like electrical contact portions 105. As a result, the side spacer 112 retains the female terminals 104 in a double manner in cooperation with housing lances 102*a* (which are provided within the respective terminal receiving chambers 103) retainingly engaged respectively in lances holes 105*b* formed respectively in bottom plates of the box-like electrical contact portions 105, and therefore the rearward withdrawal of the female terminals 104 are positively prevented. Then, the lance cover 115 is attached to the upper side of the rear portion of the housing 102.

Patent Literature 1: JP-A-2000-208200 Publication (FIGS. 1 to 5)

In the above conventional construction, however, when an external force, such as a pulling force in an upward-downward direction or a right-left direction, acts on the wires W led rearwardly out of the waterproof connector 101, each wire W swings within the range of the wire passage hole 114 of the rear holder 113, and therefore the seal member 106 received in a seal member-receiving portion also moves, following the movement of the wires W, so that the lips 107*a* are, in some cases, slightly spaced apart from an inner surface of the seal member-receiving portion to form a gap therebetween. And, there is a fear that water may intrude through this gap.

The intrusion of water through a gap between the seal member-receiving portion and the lips 07*a* can be prevented by increasing the force of pressing of the rear holder 113 against the seal member 106 so as to enhance the intimate contact therebetween. In this case, however, a reaction force acting on the rear holder 113 becomes large, and therefore there is a fear that the rear holder 113 may be disengaged from the housing 102.

Furthermore, in the type of waterproof connector in which an inner housing is movable or swingable within an outer housing for aligning purposes as in a floating connector, wires passing through a seal member are completely fixed when the seal member is compressed hard by a rear holder. Therefore, a spacer need to be provided between the seal member and the inner housing so that the inner housing can move, and this invites a problem that the connector becomes large in size.

SUMMARY OF THE INVENTION

An object of this invention is to solve the above problems of the conventional connectors, and more specifically to provide a seal member for a waterproof connector which will not be deteriorated in waterproof performance even when wires swing, and is suited for use even in the type of connector in which an inner housing is swingable as in a floating connector.

The above object of the invention has been achieved by the following construction.

(1) A seal member for a waterproof connector wherein the seal member is adapted to be mounted at a rear end of a terminal receiving chamber of the waterproof connector, and has a wire-sealing passage hole in which a wire connected to a terminal can be fitted; characterized in that a lip portion is provided at an outer peripheral portion of the seal member over an entire periphery thereof, and also lip portions are provided at front and rear sides of the seal member spaced from each other in an inserting direction, and these lip portions can be compressed and deformed between the seal member and the terminal receiving chamber.

(2) The seal member for the waterproof connector recited in the above Paragraph (1) is characterized in that the waterproof connector is of the floating type.

(3) The seal member for the waterproof connector recited in the above Paragraph (1) or Paragraph (2) is characterized in that the seal member is an integrally-molded product.

(4) The seal member for the waterproof connector recited in the above Paragraph (1) or Paragraph (2) is characterized in that the seal member has a stack structure.

In the present invention, the lip portion is provided at the outer peripheral portion of the seal member over the entire periphery thereof, and also the lip portions are provided at the front and rear sides of the seal member spaced from each other in the inserting direction, and these lip portions can be compressed and deformed between the seal member and the terminal receiving chamber. With this construction, a liquid-tight seal is always formed between the seal member and the terminal receiving chamber. And besides, even when the wires are swung by an external force, so that the seal member moves, following the swinging movement of the wires, the compressed and deformed lip portions are further deformed to allow the movement of the seal member, and therefore the sealing performance will not be lowered, thus ensuring the positive seal.

The lip portions provided at the seal member are made of an elastic material, and may be molded integrally with the seal member or may be molded separately from the seal member in which case the molded separate lip portions are fixed to the seal member.

The lip portions are made of the elastic material, such as a soft plastics material, which can be elastically deformed.

In the case where the lip portions are molded integrally with the seal member, the seal member is also made of the above elastic material, and the seal member itself can also be elastically deformed. In this case, the seal member can maintain the waterproof effect while deformed following a swinging movement of the wires, and the waterproof performance of the seal member will not be lowered, and the positive seal is ensured.

DESCRIPTION OF THE PREFERRED EMBODIMENTS

Figure 1:
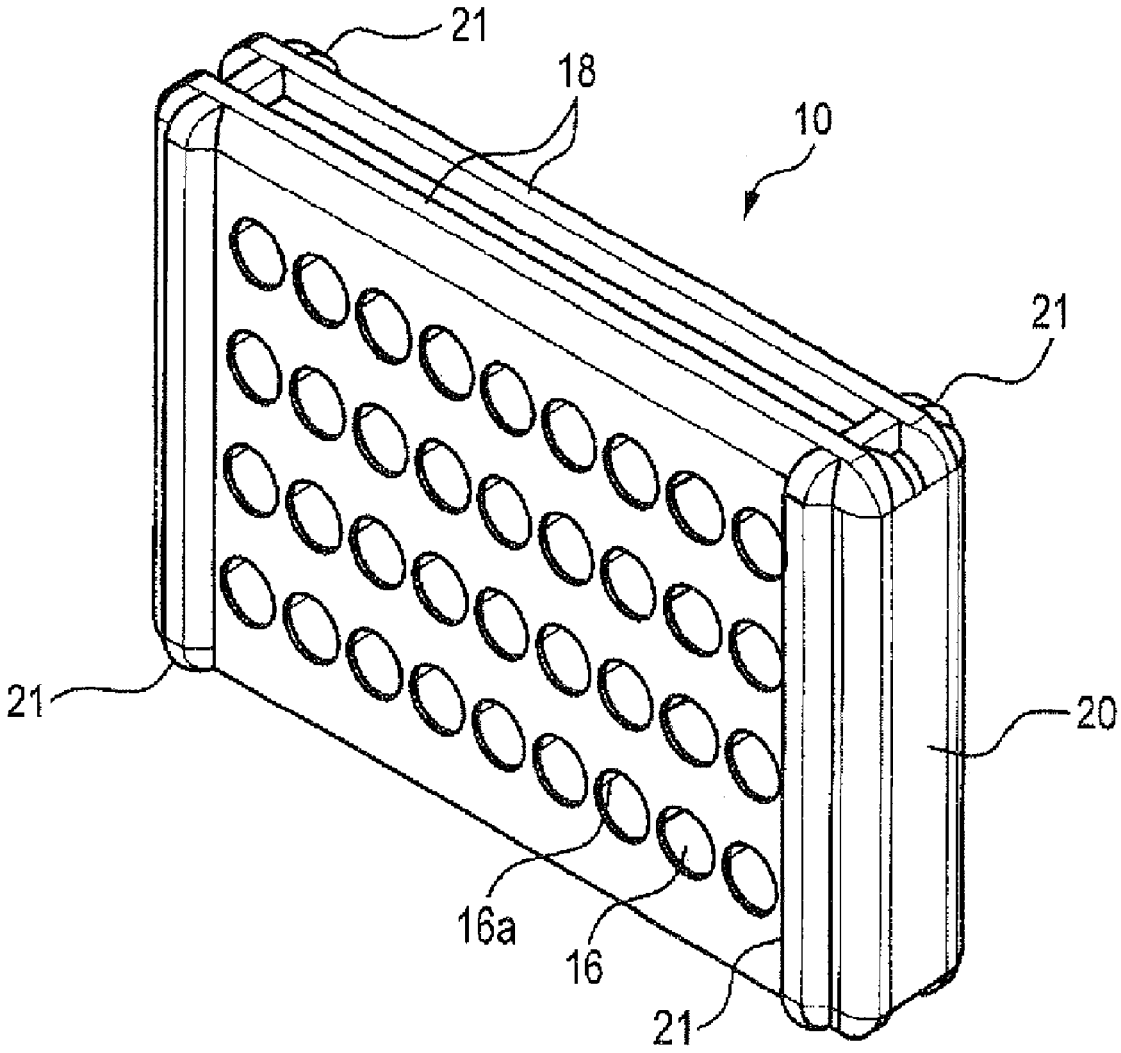
FIG. 1 is a perspective view of a first embodiment of a seal member of the present invention.
Figure 2:
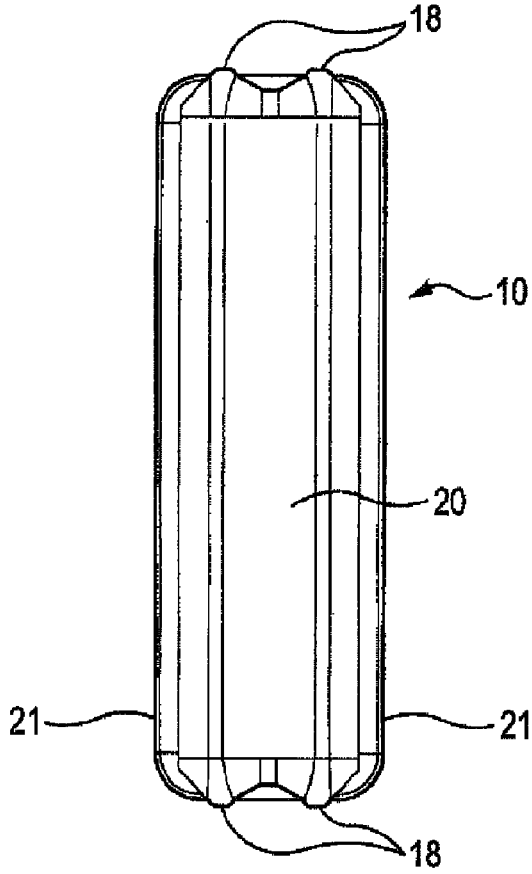
FIG. 2 is a side-elevational view of the seal member of the first embodiment.
Figure 3:
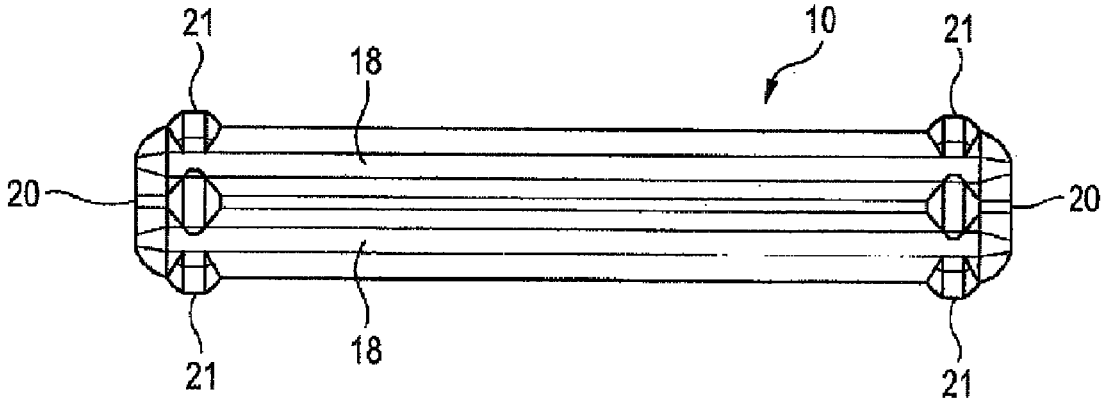
FIG. 3 is a plan view of the seal member of the first embodiment.
Figure 4:
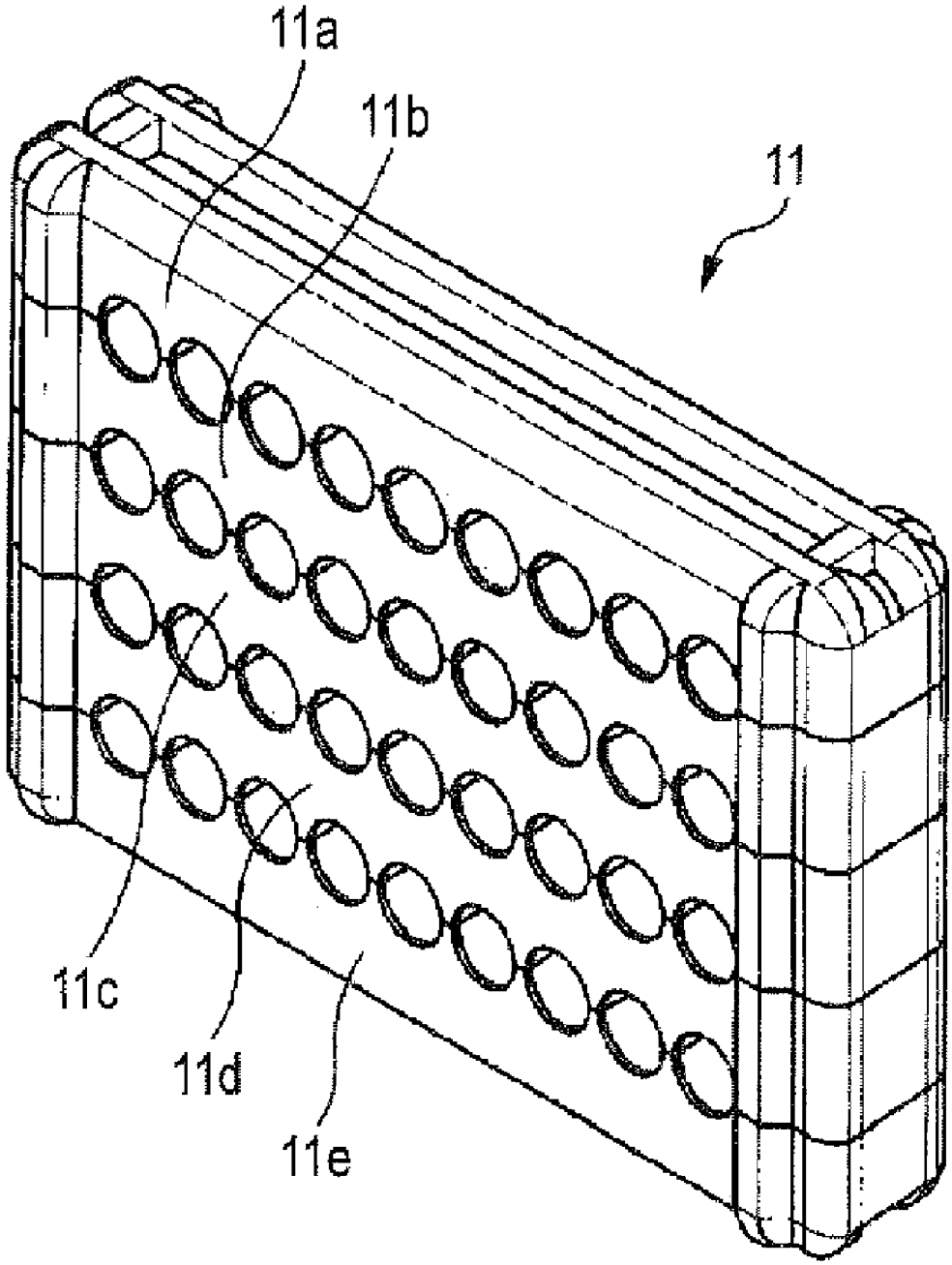
FIG. 4 is a perspective view of a second embodiment of a seal member of the invention.
Figure 5:
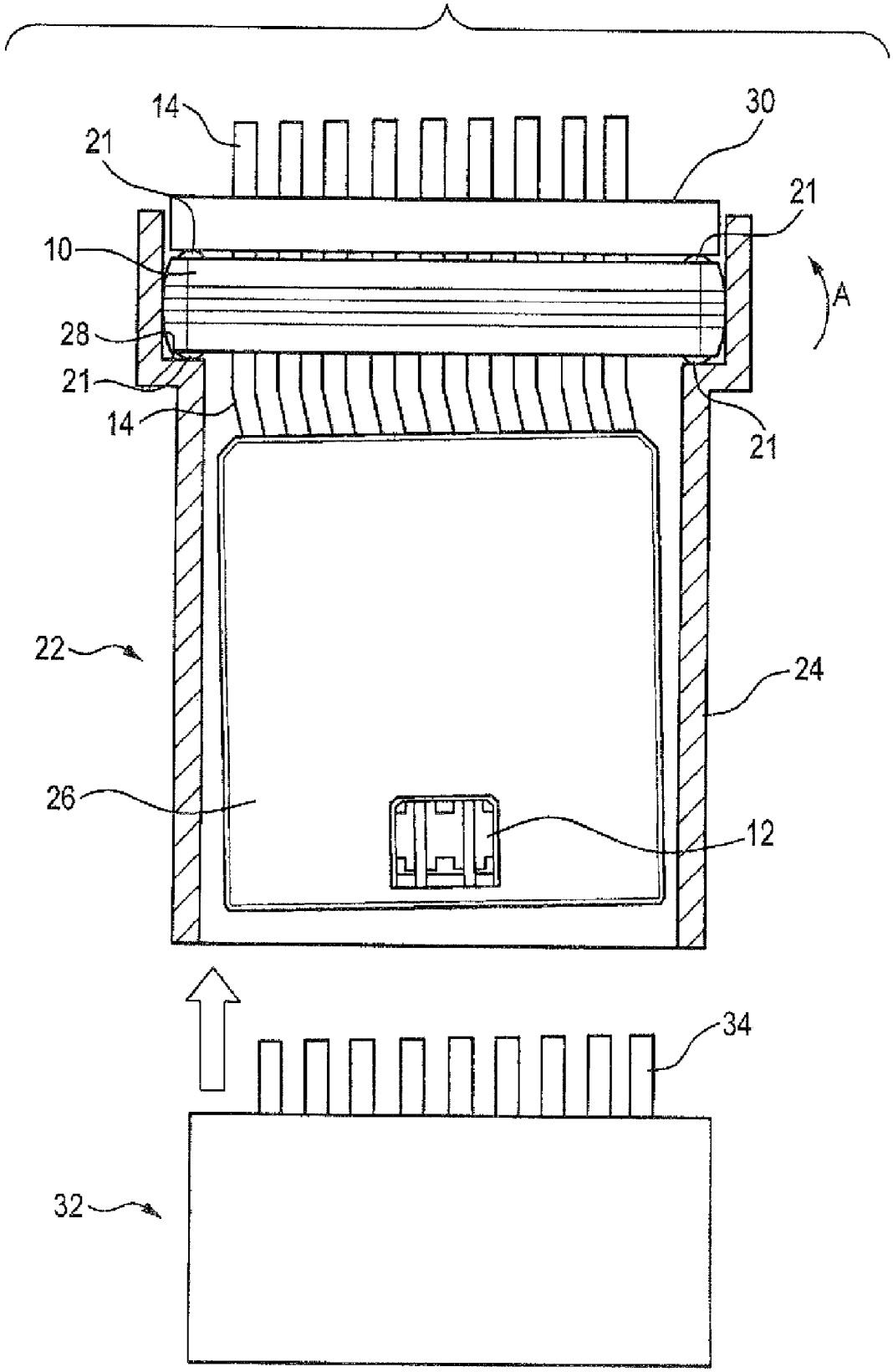
FIG. 5 is a horizontal cross-sectional view showing a condition in which the seal member is mounted in an inner housing.
Figure 6:
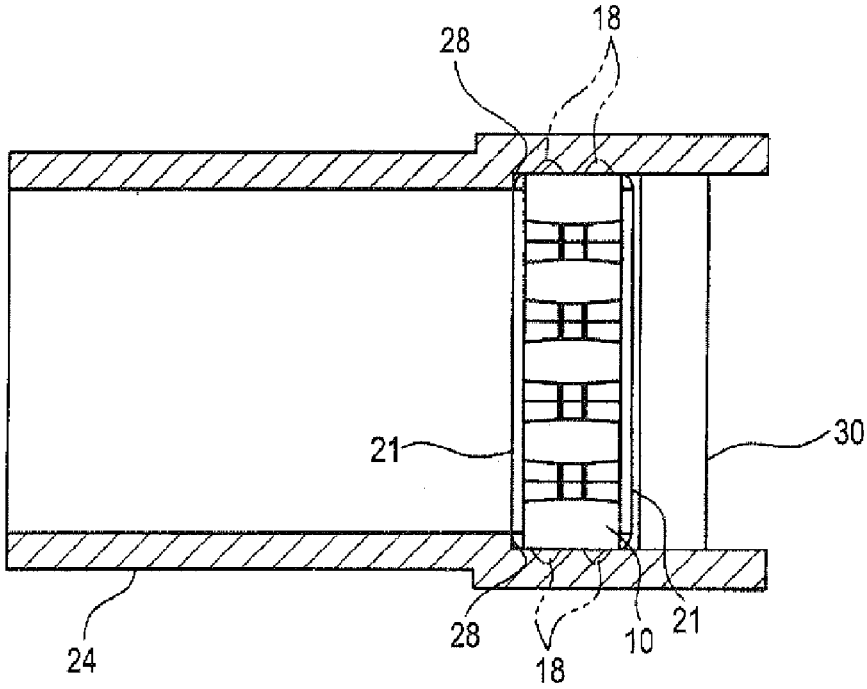
FIG. 6 is a vertical cross-sectional view showing the condition in which the seal member is mounted in the inner housing.
Figure 7:
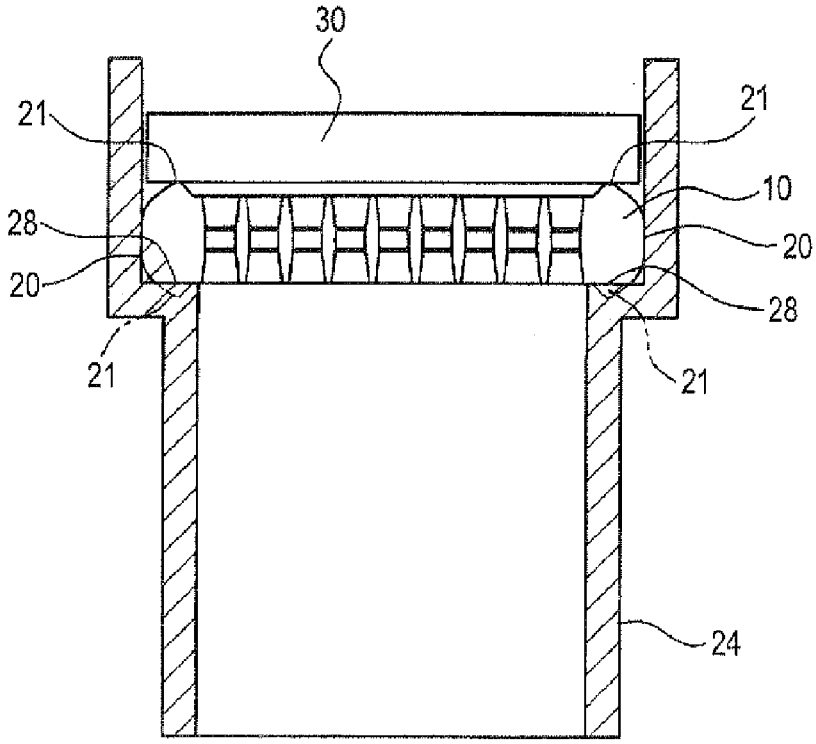
FIG. 7 is a horizontal cross-sectional view showing the condition in which the seal member is mounted in the inner housing.

Preferred embodiments of the present invention will now be described with reference to the accompanying drawings. FIG. 1 is a perspective view of a first embodiment of a seal member used in a connector, FIG. 2 is a side-elevational view of the seal member, and FIG. 3 is a plan view of the seal member. FIG. 4 is a perspective view of a second embodiment of a seal member of the invention. FIG. 5 is a horizontal cross-sectional view showing a condition in which the seal member is mounted in an inner housing of a female connector, FIG. 6 is a vertical cross-sectional view showing the condition in which the seal member is mounted in the inner housing, and FIG. 7 is a horizontal cross-sectional view showing the condition in which the seal member is mounted in the inner housing.

The seal member 10 is made of an elastic material such as rubber and a soft plastics material, and is integrally molded into a generally rectangular plate-shape, and has a predetermined thickness. Many passage holes 16 are formed through the seal member 10, and wires 14 connected respectively to terminals 12 are adapted to be passed through the respective passage holes 16. Lip portions 16*a* of a mountain-like shape are formed on an inner surface of each passage hole 16, and when the wire 14 is passed through the passage hole 16, the wire 14 is sealed liquid-tight by the lip portions 16*a*.

Lip portions 18 are formed on an outer peripheral surface of the seal member 10 over the entire periphery thereof. Two elongate lip portions 18 of a mountain-like shape are formed on each of two long sides (upper and lower sides) of the seal member 10. Also, two elongate lip portions (left and right lip portions) 20 of a mountain-like shape are formed respectively on two short sides (left and right sides) of the seal member 10, and are relatively wide in the direction of the thickness of the seal member 10. Further, two elongate lip portions (front and rear lip portions) 21 of a mountain-like shape are formed respectively at those regions disposed respectively immediately adjacent to and along widthwise-opposite ends (front and rear surfaces in an inserting direction) of each short side of the seal member 10.

Although the seal member 10 shown in FIGS. 1 to 3 is formed as a one-piece part, it is not limited to such a one-piece part. FIG. 4 shows the seal member 11 of the second embodiment, and this seal member 11 comprises a plurality of separate members 11*a*, 11*b*, 11*c*, 11*d* and 11*e* combined together in a stack in the upward-downward direction.

Next, the operation for mounting the seal member 10 will be described.

As shown in FIG. 5, the female connector 22 has a floating structure in which a plate housing 26 is received in a loosely-fitted condition within the inner housing 24. Many female terminals 12 are received within the plate housing 26, and the wires 14 are connected respectively to the female terminals 12. The wires 14 extend rearwardly from a rear end of the plate housing 26, and are fitted respectively in the passage holes 16 of the seal member 10 to be fixedly supported by the respective passage holes 16, and further extend rearwardly from the respective passage holes 16.

A receiving surface 28 for supporting the peripheral edge portion of the seal member 10 is formed on an inner surface of the inner housing 24. A rear holder 30 is attached to the inner housing 24, and is disposed at the rear side of the seal member 10, and this rear holder 30 fixes the wires 14 and the seal member 10 to the inner housing 24.

On the other hand, many male terminals 34 are received in a male connector 32, and when the male terminals 34 projecting from the male connector 32 are fitted respectively into the female terminals 12 within the inner housing 24, the male terminals 34 are electrically connected to the female terminals 12, respectively.

The female connector 22 has the floating structure, and therefore even when the male terminals 34 of the male connector 32 are inserted obliquely into the female connector 22, the plate housing 26 can move in a manner to correspond to this oblique direction, and therefore the two connectors 22 and 32 can be fitted together in a proper electrically-connected condition.

FIGS. 6 and 7 are the cross-sectional views of important portions, showing the condition in which the seal member 10 and the rear holder 30 are attached to the inner housing 24 of the female connector 22. When the seal member 10 is inserted into the inner housing 24 from the rear side thereof, the upper and lower lip portions 18 and the left and right lip portions 20 which are formed on the outer periphery of the seal member 10 are compressed and deformed between the seal member 10 and the inner surface of the inner housing 24 as shown in FIG. 6. At this time, a pressing force has not yet acted on the front and rear lip portions 21 formed at the front and rear sides of the short sides of the seal member 10, and therefore the front and rear lip portions 21 have not yet been deformed.

When the rear holder 30 is further inserted into the inner housing 24 at the rear side of the seal member 10, and is mounted in a proper position within the inner housing 24, the front lip portions 21 formed at the front sides of the short sides of the seal member 10 are pressed against the receiving surface 28 of the inner housing 24, while the rear lip portions 21 formed at the rear sides of the short sides of the seal member 10 are compressed by the rear holder 30, and therefore the front and rear lip portions 21 are deformed between the receiving surface 28 and the rear holder 30.

FIG. 6 shows the condition in which the rear holder 30 is attached to the inner housing 24, but has not yet pressed the seal member 10, and therefore the front and rear lip portions 21 have not yet been deformed. FIG. 7 shows the condition in which the rear holder 30 is attached to the inner housing 24, and only the front lip portions 21 among the front and rear lip portions 21 are deformed.

When the female terminals 12 of the plate housing 26 are fitted to the respective male terminals 34 of the male connector 32 in an oblique direction as shown in FIG. 5, a rotating force as indicated by arrow A acts on the seal member 10 because of the bending of the wires 14 fitted in the seal member 10. In the case of the conventional seal member, a gap is formed between this seal member and the inner surface of the inner housing 24. In the seal member 10 of the above construction, however, the left and right lip portions 20 of the seal member 10 are deformed, and therefore any gap will not be formed between the seal member 10 and the inner surface of the inner housing 24.

Also, even when a rotating force in the opposite direction acts on the seal member 10, the left and right lip portions 20 are deformed similarly, and therefore any gap will not be formed between the seal member 10 and the inner surface of the inner housing 24. And besides, the upper and lower lip portions 18 of the seal member 10 are also deformed similarly, any gap will not be formed between the seal member 10 and the inner surface of the inner housing 24.

Furthermore, the seal member 10 is pressed by the rear holder 30, and therefore the front lip portions 21 are deformed between the seal member 10 and the receiving surface 28 of the inner housing 24, and are held in intimate contact with the receiving surface 28, and also the rear lip portions 21 are deformed between the seal member 10 and the rear holder 30, and are held in intimate contact with the rear holder 30. Therefore, any gap will not develop between the seal member 10 and the receiving surface 28 and also between the seal member 10 and the rear holder 30.

Therefore, even when the seal member 10 is subjected to a force acting in any direction, any gap will not develop between the seal member 10 and the inner housing 24 and also between the seal member 10 and the rear holder 30, and the positive waterproof performance is ensured.

Particularly in the type of connector (such as the floating-type connector shown in FIG. 5) in which the wires 14 are liable to exert a force on the seal member 10, the positive waterproof performance can be ensured even when a force in any direction acts on the seal member 10. And besides, the seal member 10 itself is also molded of the elastic material, and therefore can be suitably deformed within the inner housing 24, and therefore the more positive waterproof effect can be achieved.

Furthermore, the rear holder 30 is held in contact with the compressed and deformed lip portions 21, and therefore a reaction force which the rear holder 30 receives from the seal member 10 is not so large, and there is no fear that the rear holder 30 is disengaged from the inner housing 24.

Figure 8:
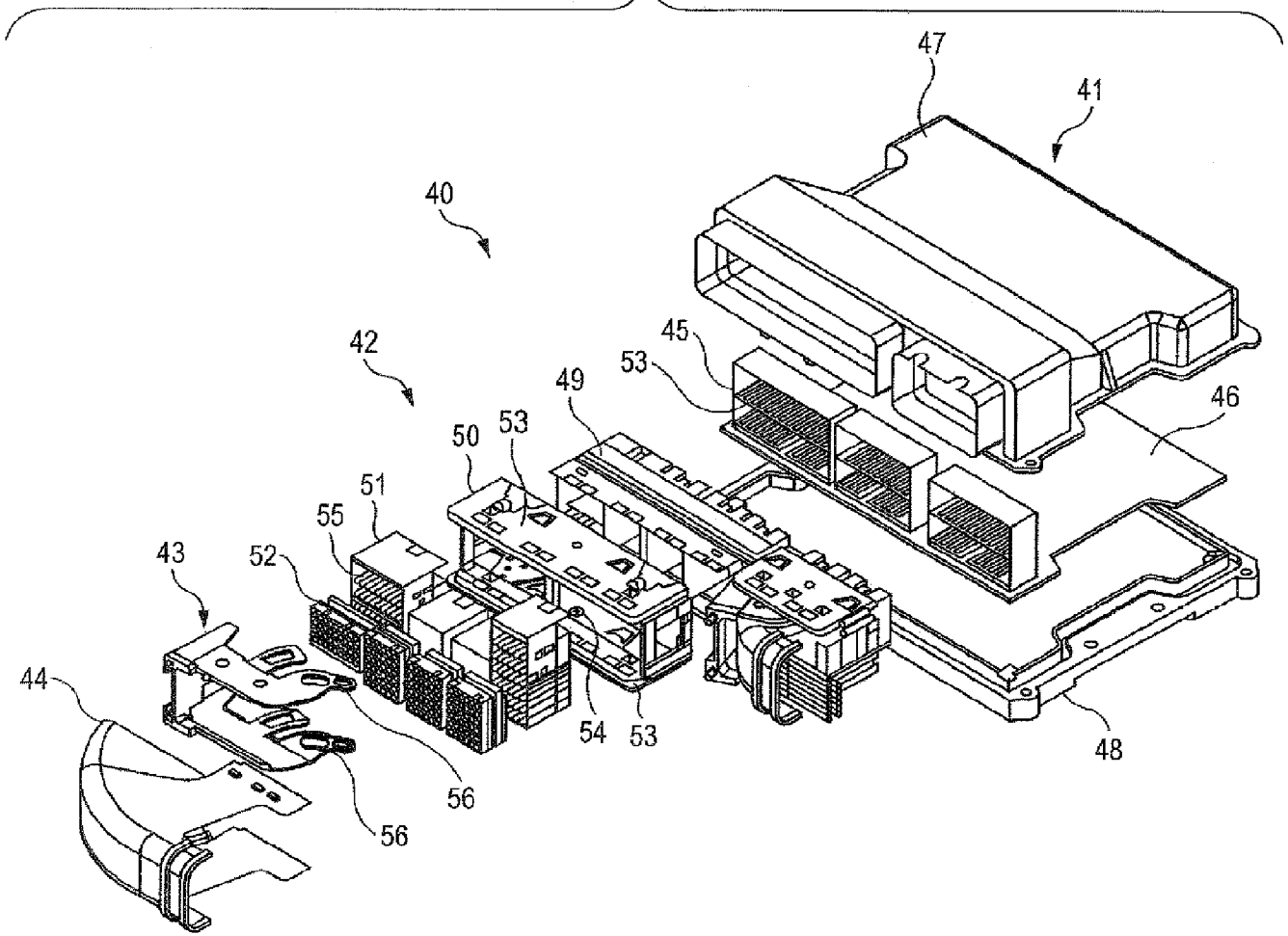
FIG. 8 is an exploded perspective view showing one example of a waterproof connector to which the invention is applied.
Figure 9:
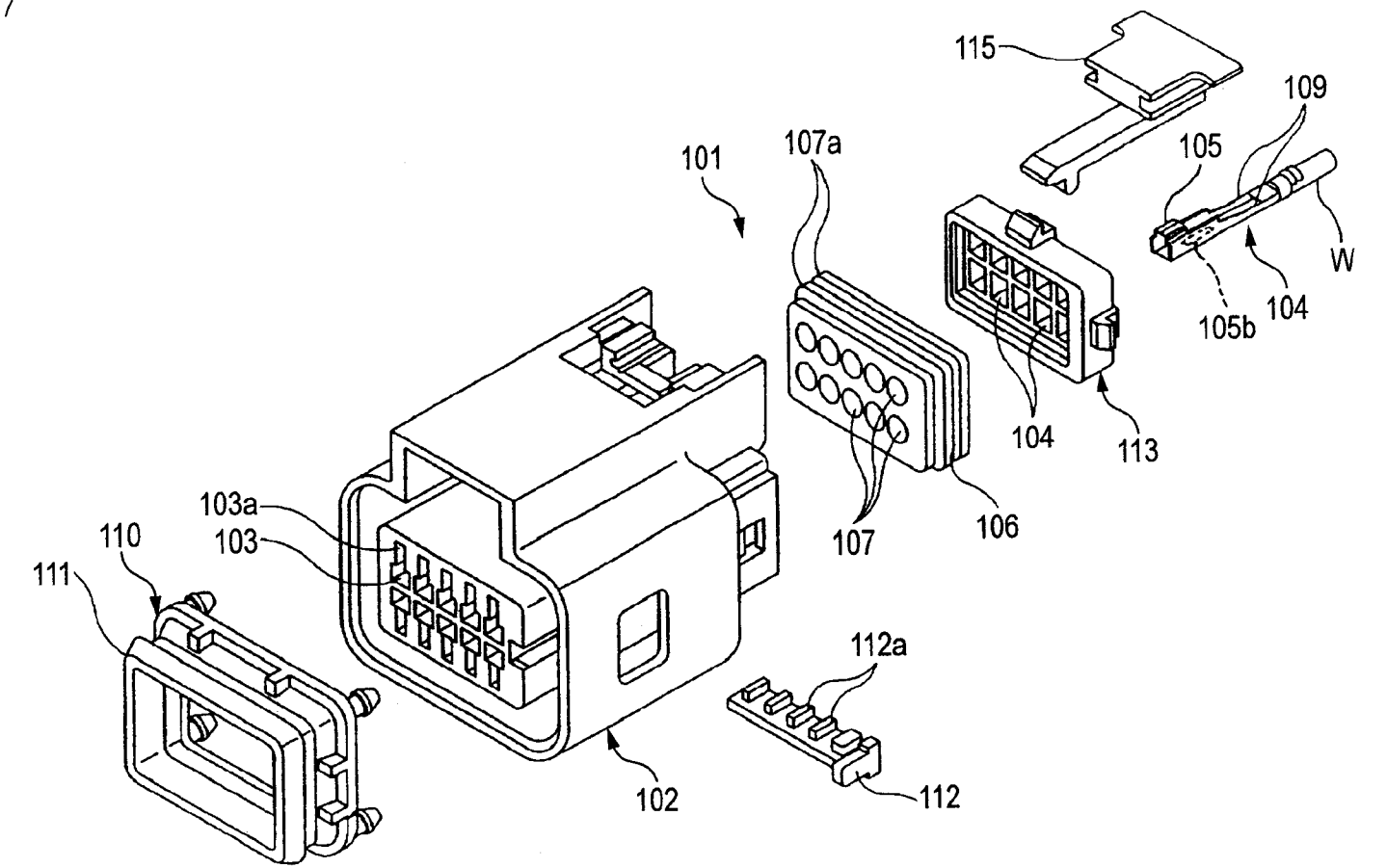
PRIOR ART FIG. 9
FIG. 9 is an exploded perspective view of a conventional waterproof connector.
Figure 10:
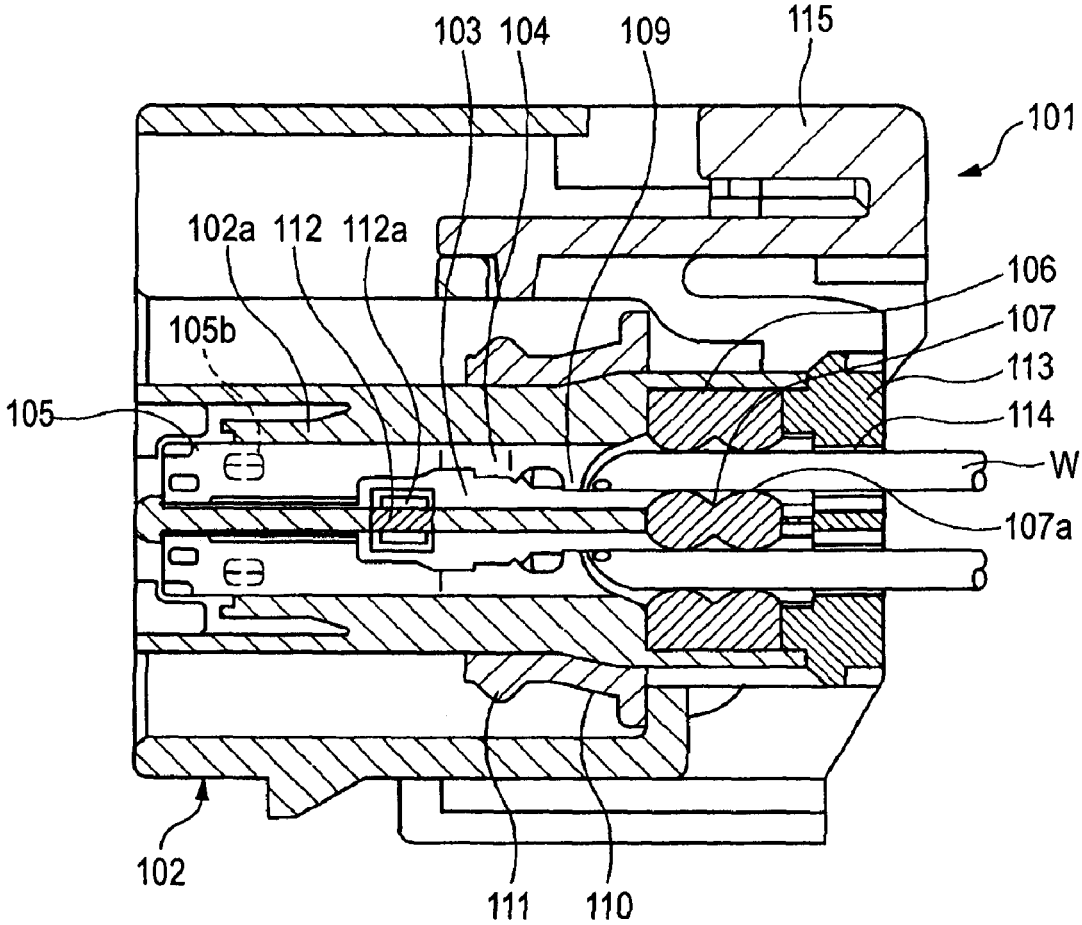
PRIOR ART FIG. 10
FIG. 10 is a cross-sectional view of the conventional connector.

FIG. 8 is an exploded perspective view showing one example of a waterproof connector to which the above embodiment is applied.

As shown in FIG. 8, the waterproof connector 40 comprises a male connector 41, a female connector 42, a lever 43, and a wire cover 44. The male connector 41 includes male housings 45, a board 46, a male outer cover 47, and a board support base 48. The female connector 42 includes a female inner housing 49, a female outer housing 50, a female plate housing 51, and wire seals 52.

The male housing 45 receives a number of male terminals 53 therein, and the male terminals 53 are mounted on the board 46, and hence are fixed to the board 46. The male terminals 53 are electrically connected to printed wiring (formed on the board 46) and electronic elements or devices mounted on the board 46. The male outer cover 47 is fixed to the board support base 48, with the board 46 interposed therebetween, such that the male housings 45 are disposed at an end portion of the male connector 41.

The female inner housing 49 is formed into a square frame-like shape, and is received in the female outer housing 50 slightly larger in size than the female inner housing 49. The female outer housing 50 has pivot shafts 54 formed on and projecting respectively from inner surfaces of top and bottom plates 53 thereof. The pivot shafts 54 are engaged respectively in pivot holes 56 formed in the lever 43.

The female plate housing 51 receives a number of female terminals 55 therein, and the female plate housing 51 is received in the female inner housing 49, and then by pivotally moving the lever 43, the female inner housing 49 is slid toward the male housing 45 through the female outer housing 50, thereby connecting the female terminals 55 to the respective male terminals 53. Wires (not shown) electrically connected to the respective female terminals 55 are held liquid-tight by the wire seal 52 attached to the female plate housing 51, and are covered and protected by the wire cover 44 attached to the outside of the female outer housing 50.

The seal member of the above embodiment can be used as the wire seal for the waterproof connector shown in FIG. 8, and achieves the above-mentioned advantageous effects.

What is claimed is:

1. A seal member for a waterproof connector, adapted to be mounted at a rear end of a terminal receiving chamber of the waterproof connector, comprising:

a seal main body including a front face which faces the waterproof connector upon being mounted thereto and a rear face opposite the front face, said seal main body having a wire-sealing passage hole in which a wire connected to a terminal is fitted;

a first lip portion provided around an entire periphery of an outer peripheral portion of said seal main body, and second lip portions respectively provided on the front face and the rear face of said seal main body;

wherein each of the second lip portions contacts the first lip portion.

2. The seal member for a waterproof connector according to claim 1, wherein said waterproof connector is comprised of an inner housing and an outer housing; and the inner housing is swingably provided within the outer housing.

3. The seal member for a waterproof connector according to claim 1, wherein said seal main body is an integrally-molded product.

4. The seal member for a waterproof connector according to claim 1, wherein said seal main body has a stack structure.

5. The seal member for a waterproof connector according to claim 1, wherein said second lip portions are projections which extend along opposite sides of the seal main body.

6. The seal member for a waterproof connector according to claim 1, wherein said second lip portions includes a first pair of lip projections on the rear face of the seal main body and a second pair of lip projections on the front face of the seal main body.

7. The seal member for a waterproof connector according to claim 6, wherein the first pair of lip projections extend along opposite sides of the seal main body.

8. The seal member for a waterproof connector according to claim 7, wherein the second pair of lip projections extend along opposite sides of the seal main body.

9. The seal member for a waterproof connector according to claim 6, wherein the second pair of lip projections are deformed against a rear face of the waterproof connector upon mounting of the seal main body to the waterproof connector.

10. The seal member for a waterproof connector according to claim 1, wherein said seal main body is substantially planar.

11. The seal member for a waterproof connector according to claim 1, wherein each of the second lip portions crosses the first lip portion.

12. The seal member for a waterproof connector according to claim 5, wherein said second lip portions extend substantially linearly along opposite lateral sides of the seal main body.

13. The seal member for a waterproof connector according to claim 7, wherein said the first pair of lip projections extend substantially linearly along opposite lateral sides of the seal main body.

14. The seal member for a waterproof connector according to claim 13, wherein said the first pair of lip projections extend substantially linearly along opposite lateral sides of the seal main body.

* * * * *